US006302172B1

(12) United States Patent
De Villele

(10) Patent No.: US 6,302,172 B1
(45) Date of Patent: Oct. 16, 2001

(54) DEVICE FOR SUPPORTING A RECEPTACLE IN A CANTILEVERED-OUT POSITION

(75) Inventor: Damien De Villele, La Ferte Bernard (FR)

(73) Assignee: Serac Group, La Ferte Bernard (FR)

( * ) Notice: Subject to any disclaimer, the term of this patent is extended or adjusted under 35 U.S.C. 154(b) by 0 days.

(21) Appl. No.: 09/531,225

(22) Filed: Mar. 20, 2000

(30) Foreign Application Priority Data

Mar. 26, 1999 (FR) ..... 99 03816

(51) Int. Cl.[7] ..... B67C 3/24
(52) U.S. Cl. ..... 141/372; 198/470.1; 198/803.7
(58) Field of Search ..... 141/370–373; 198/470.1, 473.1, 803.7

(56) References Cited

U.S. PATENT DOCUMENTS 717,033 * 12/1902 Schneider ..... 141/372
1,726,479 8/1929 Engle .
2,681,135 * 6/1954 Vierling ..... 198/803.7
4,498,508 * 2/1985 Scholle et al. ..... 141/372
4,512,456 4/1985 Peyton ..... 198/479
5,711,411 1/1998 Zurweller ..... 198/470.1
6,073,667 * 6/2000 Graffin ..... 141/372

FOREIGN PATENT DOCUMENTS 29713510 8/1998 (DE) .

* cited by examiner

*Primary Examiner*—J. Casimer Jacyna

(57) ABSTRACT

A support device for supporting, in a cantilevered-out position, a receptacle having a neck that includes a collar, the device comprising a resiliently-closable clamp having first and second hinged-together jaws, and a rigid support element presenting a lateral opening forming a housing for a portion of the neck and a support for the collar of the receptacle, the support element extending beneath the clamp and being spaced apart therefrom.

4 Claims, 2 Drawing Sheets

DEVICE FOR SUPPORTING A RECEPTACLE IN A CANTILEVERED-OUT POSITION

The present invention relates to a device for supporting, in a cantilevered-out position, a receptacle having a neck including a collar. The device is suitable for use in particular in installations for filling receptacles.

BACKGROUND OF THE INVENTION

In general, a device for supporting a receptacle in a cantilevered-out position comprises a resiliently closable clamp having two jaws hinged to each other and urged towards a closed position by a return spring. One of the jaws has means for enabling the device to be fixed to an installation such as a rotary filling platform.

On a platform of that type, the clamp of the support device holds the neck of the receptacle so as to suspend the receptacle beneath a filling spout.

While the platform is rotating, the receptacle tends to tilt under the action of centrifugal force. The projected cross-section thus presented by the neck of the receptacle beneath the filling spout is elliptical in shape and smaller than the real cross-section of the neck which is circular. Unfortunately, the maximum filling flow rate and thus the transverse dimensions of the jet of filling substance are determined relative to the real cross-section of the neck. There therefore exists a risk that the filling substance will flow outside the receptacle while the platform is rotating.

To remedy that drawback, proposals have been made to reduce the filling flow rate so as to reduce the size of the filling jet. However that reduces productivity. Another solution consists in using a return spring of high stiffness so as to exert a clamping force on the neck that is sufficient to prevent the receptacle from tilting. It is then more difficult to put the receptacle into place in the clamp and to remove it therefrom. This is particularly troublesome in installations where filling is performed by weight and in which the support device is associated with a weight sensor. The forces exerted to move apart the jaws of the clamp while the receptacle is being put into place and removed then give rise to mechanical forces on the weight sensor that run the risk of damaging the sensor and of reducing its accuracy.

OBJECTS AND SUMMARY OF THE INVENTION

An object of the invention is to provide a device for supporting a receptacle in a cantilevered-out position, while limiting the extent to which the receptacle can tilt under centrifugal force and while keeping it easy to put the receptacle into place in the device and to remove the receptacle therefrom.

To achieve this object, the invention provides a support device for supporting, in a cantilevered-out position, a receptacle having a neck that includes a collar, the device comprising a resiliently-closable clamp that includes first and second hinged limbs with ends that form first and second jaws, and a rigid support element having a lateral opening that forms a housing for a portion of the neck and a support for the collar of the receptacle, the support element extending beneath the clamp and being spaced apart therefrom.

Thus, the receptacle rests on the support element and it is held in position on the support element by the clamp extending over the support element. The gap between the support element and the clamp makes it possible to have a relatively large height for holding the neck which is sufficient to ensure that limited closure force associated with the thrust supplied by the support element suffices to reduce the risk of the receptacle tilting.

Advantageously, for the first limb being provided with means for fixing the device on an installation, the first jaw presents at least one reference face that is substantially vertical and perpendicular to a vertical plane of symmetry of the opening of the support element. This reference face contributes to holding the receptacle in the vertical position. In addition, this reference face constitutes a fixed reference enabling the receptacle to be positioned accurately in the installation.

In which case, it is preferable for the first jaw to present a second reference face that is substantially vertical and that forms an angle with the first reference face so as to constitute a V-shape for positioning the neck, the second jaw being shaped to have a free end extending, when the clamp is closed, so as to face the positioning V-shape in order to form means for pressing the neck of the receptacle into the positioning V-shape. This further improves holding of the receptacle in a vertical position and accurate positioning of the receptacle.

BRIEF DESCRIPTION OF THE DRAWINGS

Other characteristics and advantages of the invention will appear on reading the following description of a particular non-limiting embodiment of the invention.

Reference is made to the accompanying drawings, in which.

MORE DETAILED DESCRIPTION

Figure 1:
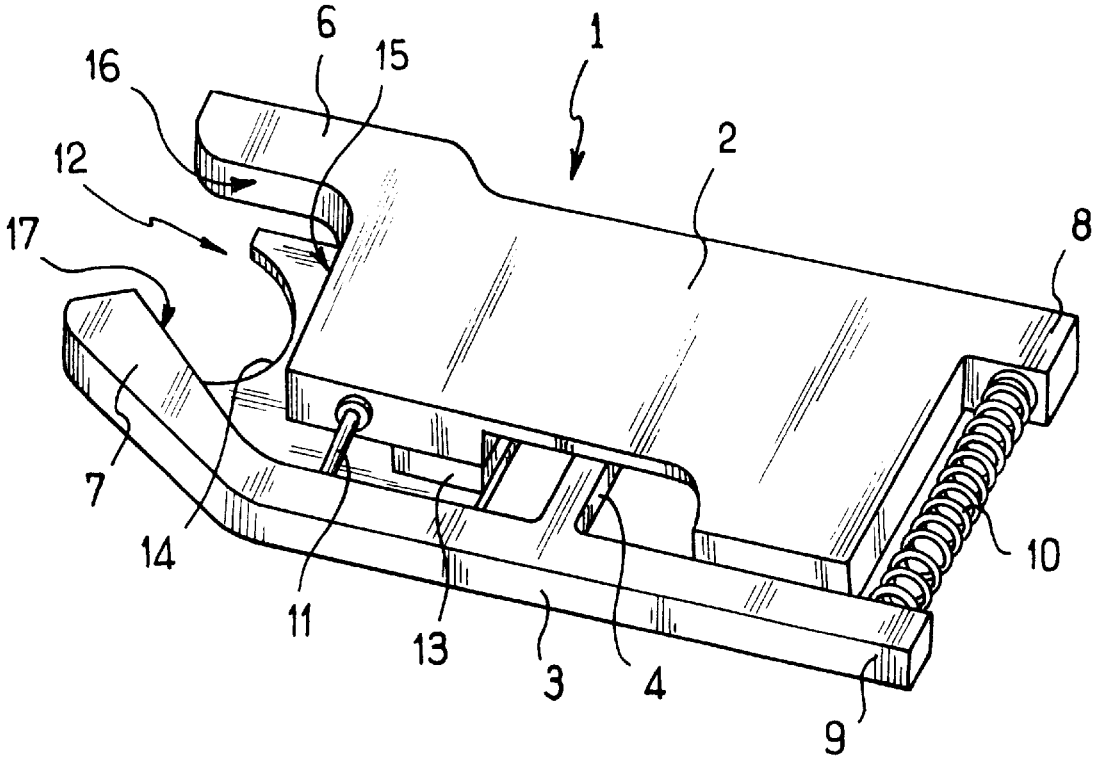
FIG. 1 is a perspective view of a support device of the invention for supporting in a cantilevered-out position.
Figure 2:
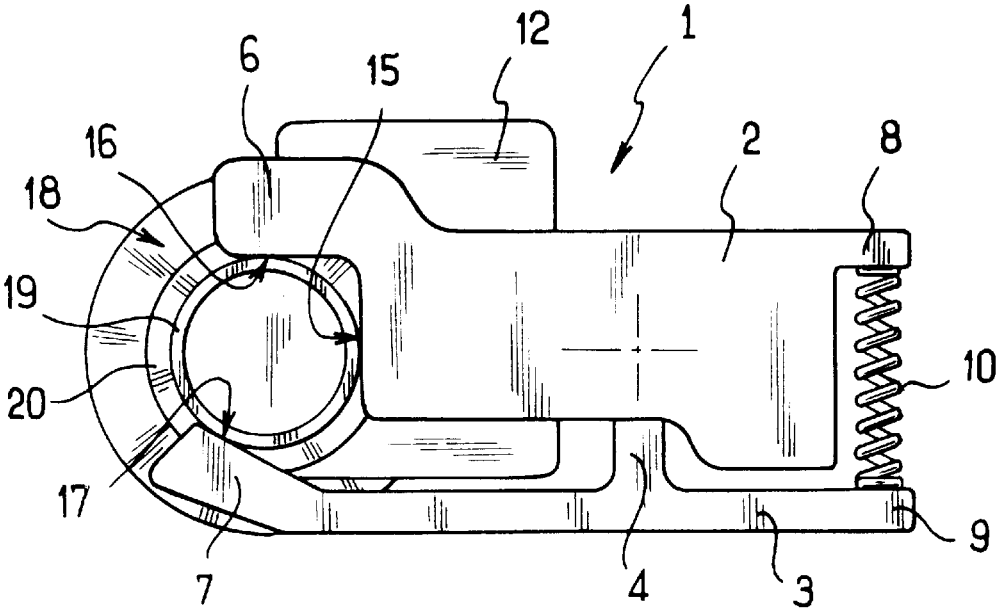
FIG. 2 is a plan view of the support device, a receptacle being held therein.

The support device described below is designed to support receptacles 18 in a cantilevered-out position, each receptacle having a cylindrical neck 19 and a collar 20 extending around the neck 19.

The support device of the invention comprises a clamp given overall reference 1, and having a first limb 2 and a second limb 3. The second limb 3 comprises a link arm 4 extending laterally relative to the limb 3 and having one end mounted to pivot on the limb 2 about a hinge axis 5.

The limbs 2 and 3 have facing ends forming respective jaws 6 and 7. At their ends remote from the jaws 6 and 7, the limbs 2 and 3 have ends 8 and 9 between which there extends a spring 10 to exert force tending to move the jaws 6 and 7 towards each other. An adjustable abutment finger 11 secured to the limb 3 between the jaw 7 and the link arm 4 has a free end bearing against the limb 2 in order to limit closure of the clamp.

The support device also has a support element given overall reference 12 and constituted by a rigid plate extending beneath the clamp 1 and spaced apart therefrom. The support element 12 is mounted on the limb 2 via a spacer 13. A notch 14 is formed in the plate forming the support element 12 in register with the opening defined by the jaws 6 and 7. The shape of the notch 14 corresponds to the shape of the neck 19, and in this case the notch is semicircular, of diameter lying between that of the collar 20 and that of the neck 19.

Figure 3:
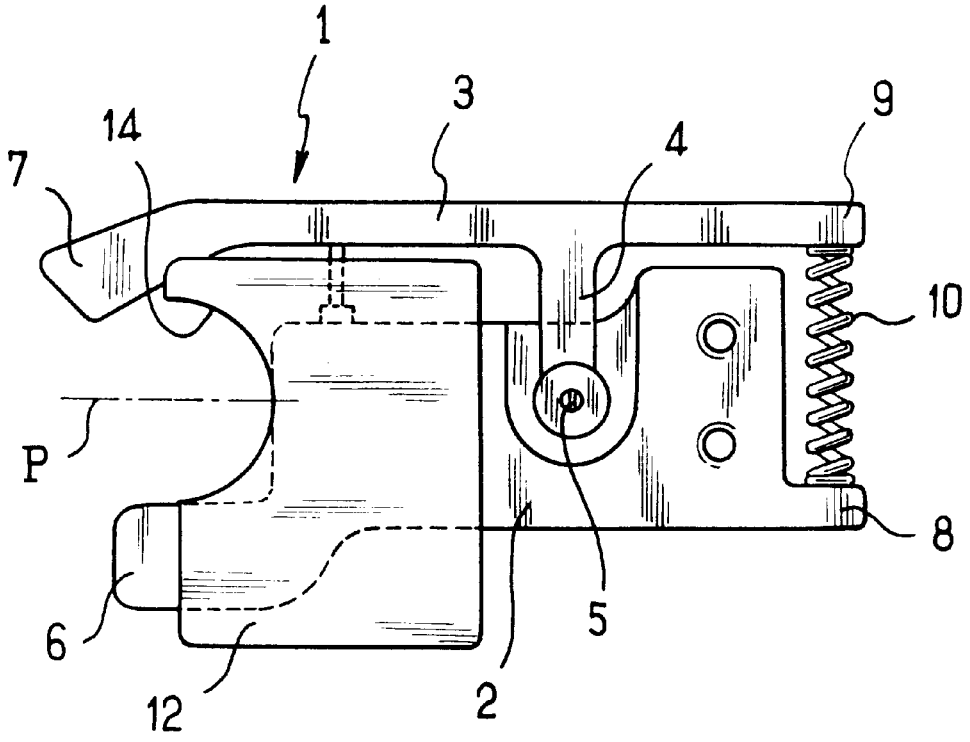
FIG. 3 is a view of the support device from beneath.
Figure 4:
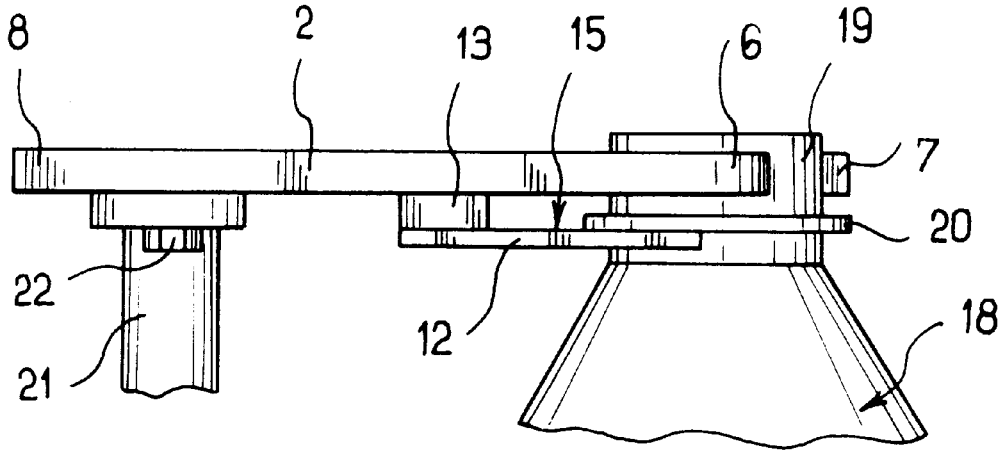
FIG. 4 is an elevation view of the support device of the invention in position on an installation and supporting a receptacle.

The jaw 6 has a first reference face 15 that is vertical and perpendicular to the vertical plane of symmetry P of the notch 14 of the support element 12 (see FIG. 3). The jaw 6 also has a second reference face 16 that is vertical and that forms an angle of 90° with the first reference face 15 so as to constitute a positioning V-shape.

The jaw 7 has a bearing face 17 which, when the jaws 6 and 7 are closed, extends substantially facing the positioning V-shape defined by the reference faces 15 and 16.

In use, the clamp 1 is fixed to a rotary filling platform, for example. The limb 2 of the clamp is fixed on an upright 21 by screws 22. The clamp is preferably mounted on the platform in such a manner that the reference face 15 extends perpendicularly to a radius of the platform passing through the axis of rotation thereof.

When the receptacle 18 is held suspended in a vertical position by the support device of the invention, the portion of the neck 19 that extends above the collar is received between the jaws 6 and 7.

The bearing face 17 of the jaw 7 exerts a force on the neck 19 pressing it against the reference faces 15 and 16 that form the positioning V-shape. The portion of the neck 19 that extends beneath the collar is then received in the notch 14, and the collar rests on the top face of the support element 12.

Naturally, the invention is not limited to the embodiment described and variants can be applied thereto without going beyond the ambit of the invention as defined by the claims.

In particular, the angle formed between the reference faces can be other than 90°, or the clamp can have no reference face or can have only one reference face.

In addition, the support device can also be organized to support receptacles having necks that are of polygonal or other section.

Furthermore, the support element 12 can be made integrally with the limb 2.

Although the clamp is shown with one limb fixed to the platform and with a moving limb that is hinged thereto, the clamp could be fixed to the platform in such a manner as to have two moving limbs.

What is claimed is:

1. A support device for supporting, in a cantilevered-out position, a receptacle having a neck that includes a collar, the device comprising a resiliently-closable clamp that includes first and second hinged limbs with ends that form first and second jaws, and a rigid support element having a lateral notch which has dimensions lower than the collar and extends beneath the clamp in a position spaced apart therefrom, whereby two separate portions of the neck on both sides of the collar can be simultaneously introduced in the notch and between the jaws.

2. The support device according to claim 1, wherein, for the first limb being provided with means for fixing the device on an installation, the first jaw presents at least one reference face that is substantially vertical and perpendicular to a vertical plane of symmetry of the opening of the support element.

3. The support device according to claim 2, wherein the first jaw presents a second reference face that is substantially vertical and that forms an angle with the first reference face so as to constitute a V-shape for positioning the neck, the second jaw being shaped to have a free end extending, when the clamp is closed, so as to face the positioning V-shape in order to form means for pressing the neck of the receptacle into the positioning V-shape.

4. The support device according to claim 3, wherein the reference faces are perpendicular to each other.

* * * * *